United States Patent [19]

Narasimham

[11] 4,449,568

[45] May 22, 1984

[54] CONTINUOUS CASTING CONTROLLER

[75] Inventor: Mandayam C. Narasimham, Flanders, N.J.

[73] Assignee: Allied Corporation, Morris Township, Morris County, N.J.

[21] Appl. No.: 312,208

[22] Filed: Oct. 19, 1981

Related U.S. Application Data

[63] Continuation of Ser. No. 125,722, Feb. 28, 1980, abandoned, which is a continuation of Ser. No. 971,618, Dec. 20, 1978, abandoned.

[51] Int. Cl.[3] ..... B22D 11/06; B22D 11/10; B22D 11/16

[52] U.S. Cl. ..... 164/453; 164/423; 164/437; 164/449; 164/463; 222/595

[58] Field of Search ..... 164/453, 457, 488, 463, 164/151, 449, 155, 437, 423, 427; 222/595, 56, 394

[56] References Cited

U.S. PATENT DOCUMENTS

| | | | |
|---|---|---|---|
| 3,504,825 | 4/1970 | Diamond et al. | 222/595 X |
| 3,510,345 | 5/1970 | Marchant | 164/133 |
| 3,522,836 | 8/1970 | King | 164/463 |
| 3,538,884 | 11/1970 | Carreker, Jr. et al. | 164/155 X |
| 3,856,074 | 12/1974 | Kavesh | 164/423 X |
| 3,881,541 | 5/1975 | Bedell | 164/480 |
| 3,938,583 | 2/1976 | Kavesh | 164/423 |
| 3,939,900 | 2/1976 | Polk et al. | 164/423 |
| 3,976,117 | 8/1976 | Olsson | 164/48 |

FOREIGN PATENT DOCUMENTS

| | | | |
|---|---|---|---|
| 431964 | 12/1974 | U.S.S.R. | 222/595 |

*Primary Examiner*—Nicholas P. Godici
*Assistant Examiner*—J. Reed Batten, Jr.
*Attorney, Agent, or Firm*—Ernest D. Buff; Gerhard H. Fuchs

[57] ABSTRACT

Apparatus is provided for controlling the extrusion of molten metal from a tundish through a nozzle onto a rotating quenching surface in the high speed continuous casting of glassy metal alloy continuous filaments. An inverted pressure bell is disposed in the tundish containing molten metal. A controller, in response to the sensing of the liquid level outside the pressure bell, regulates the gas pressure inside the pressure bell to maintain a constant liquid level outside the pressure bell as molten metal flows from the tundish through the nozzle and therefore to maintain a substantially constant pressure at the nozzle inlet. As the quantity of the molten metal in the tundish is depleted, the controller, in response to the sensing of the gas pressure inside the pressure bell, causes molten metal to be supplied to the tundish as a low liquid level limit is approached in the pressure bell. In addition to the control function during steady state operation, the apparatus provides for nearly instantaneous on-off capability by rapid reduction of the bell pressure to a subatmospheric pressure, thus facilitating interruption of the casting operation.

5 Claims, 2 Drawing Figures

CONTINUOUS CASTING CONTROLLER

This is a continuation, of application Ser. No. 125,722, filed Feb. 28, 1980, which, in turn, is a continuation of Ser. No. 971,618, filed Dec. 20, 1978 both now abandoned.

BACKGROUND OF THE INVENTION

This invention relates generally to the continuous casting of continuous filaments of glassy metal alloys. Specifically, this invention relates to molten alloy flow control in the continuous casting process wherein the molten alloy is extruded through a nozzle onto a rotating quench surface.

Extruding a molten alloy through a nozzle onto a rotating quench surface is one of the several basic methods known for quenching a molten alloy to a glassy state in the form of a continuous filament. Examples are shown in U.S. Pat. No. 3,938,583 "Apparatus for Production of Continuous Metal Filaments", issued Feb. 17, 1976, to S. Kavesh, wherein extruded melt is continuously directed onto the peripheral surface of a rotating cylindrical quench wheel; in U.S. Pat. No. 3,881,541 "Continuous Casting of Narrow Filament Between Rotary Chill Surfaces", issued May 6, 1975, to J. Bedell, wherein extruded melt is directed into the nip of two counterrotating quench wheels; and in U.S. Pat. No. 3,939,900 "Apparatus for Continuous Casting Metal Filament on Interior of Chill Roll", issued Feb. 24, 1976, to D. Polk and J. Bedell, wherein extruded melt is directed onto the interior surface of a rotating annular quench wheel. Various nozzle configurations may be utilized, as for example in U.S. Pat. No. 3,976,117 "Converting Molten Metal into a Semi-Finished or Finished Product", issued Aug. 24, 1976 to E. Olsson, wherein the casting nozzle is in close proximity to the moving quench surface.

For commercial scale applications, an uninterrupted and continuous supply of molten alloy at the rotating quench surface is required so that filaments of indefinite length may be continuously cast. Conversely, nearly instantaneous on-off capability is desirable for emergency shutdown or other interruptions of operation. Additionally, pressure at the inlet of the extrusion nozzle must be controlled within narrow limits to maintain quality control of the transverse dimensions of the cast filament.

The degree of dimensional constancy along the length of the continuously cast filament is sensitive to variations in the physical characteristics of the stream of extruded melt impinging upon the rotating quench surface and therefore sensitive to extrusion pressure at the inlet of the extrusion nozzle. Dimensional control difficulties arise from at least two aspects of the operation. First, linear casting speeds are high, typically about 75 to 2100 meters per minute; and second, the thickness of the cast filament or strip is extremely small, typically about 50 microns or so. Glassy metal alloy filaments are necessarily thin due to heat transfer requirements, since extremely high quench rates, typically $10^6$° C. per second, are required to prevent crystallization in cooling the alloy from its melting temperature below its glass transition temperature.

The present invention utilizes an inverted pressure bell and associated feedback control means to maintain a nearly constant molten alloy level in the tundish as the molten alloy is extruded and therefore to provide a continuous supply of molten alloy at a substantially constant pressure at the extrusion nozzle inlet. Generally, the use of an inverted pressure bell for level control of molten metal within a crucible is known. Examples are given in U.S. Pat. No. 3,510,345 "Apparatus and Method for Automatically Controlling the Molten Metal Bath Level in a Metallurgical Process", issued May 5, 1970, to P. Marchant and in U.S. Pat. No. 3,522,836 "Method of Manufacturing Wire and the Like", issued Aug. 4, 1970, to D. King.

The present invention differs considerably from gross metallurgical processes as shown in Marchant's patent for the dip forming of steel wire or rod. In the production of continuous filaments of glassy metal alloys, successful production depends critically on the close control of the process variables, owing to the extremely high heat transfer rates required for glassy metal formation and the resulting extremely thin shapes of the cast filament.

The present invention also differs significantly from other methods for the continuous casting of glassy metal alloys that do not extrude a molten metal onto a moving quench surface. For example, in King's patent use of an inverted pressure bell is disclosed in a batch operation for maintaining the molten metal pressure at an orifice for continuously forming a meniscus, which is simultaneously swept away by a rotating quench surface (a wiping action). King's method involves casting rates much lower than those methods of concern in the present invention and therefore does not require a quick response controller. Also, King's method inherently provides for instantaneous on-off capability, controlled merely by stopping the rotation of the quench surface.

SUMMARY OF THE INVENTION

The present invention provides for the control of the extrusion of molten metal from a tundish through a nozzle onto a rotating quenching surface in the high speed continuous casting of glassy metal alloy continuous filaments, such that a continuous flow of molten metal at a substantially constant pressure is supplied at the inlet of the nozzle. An inverted pressure bell is disposed in the tundish containing molten metal. A controller, in response to the sensing of the liquid level outside the pressure bell, regulates the gas pressure inside the pressure bell to maintain a substantially constant liquid level outside the pressure bell as molten metal flows from the tundish through the nozzle and therefore to maintain a substantially constant pressure at the nozzle inlet. As the quantity of molten metal in the tundish is depleted, the controller, in response to the sensing of the gas pressure inside the pressure bell, causes molten metal to be supplied to the tundish as a low liquid level limit is approached inside the pressure bell. In addition to the control function during steady state operation, the apparatus provides nearly instantaneous on-off capability by rapid reduction of the bell pressure to a subatmospheric pressure, thus facilitating interruption of the casting operation, such as for emergency shutdown or for a change of nozzle.

The apparatus of the invention includes (a) a chill roll having cooling means for quenching a stream of molten metal at a quench rate sufficient for glass formation, (b) a nozzle disposed so as to direct a stream of molten metal onto the chill surface of the chill roll, and (c) extrusion means for continuously and indefinitely extruding the molten metal through the nozzle at a substantially constant pressure from a reservoir containing molten metal. The extrusion means may further include (d) an inverted pressure bell disposed in the reservoir, spaced from the bottom surface thereof and having its side walls at least partially immersed below the level of molten metal contained in the reservoir, (e) a gas regulator for regulating a quantity of inert gas in the bell to selectively apply pressure on the surface of the molten metal contained therein, (f) a pressure sensor for sensing the pressure of the gas within the bell, (g) level detection means for sensing the level of the molten metal contained in the reservoir outside the bell, (h) first control means for maintaining a substantially constant pressure at the inlet of the nozzle by controlling the quantity of the gas in the bell in response to the level detection means, and (i) second control means for maintaining the level of the molten metal within the bell by controlling an input flow of molten metal to the reservoir in response to the pressure sensor. The first and second control means may further include a microcomputer controller.

Additionally, the method of the invention includes the steps of (a) moving a chill surface of a chill roll, having cooling means for quenching a continuous flow of molten metal at a quench rate sufficient for glass formation, past a nozzle disposed so as to direct a stream of molten metal onto the chill surface of the chill roll, and (b) continuously and indefinitely extruding the molten metal through the nozzle at a substantially constant pressure from a reservoir containing molten metal. Step (b) may further include (c) disposing an inverted pressure bell in the reservoir, spaced from the bottom surface thereof and having its side walls at least partially immersed below the level of the molten metal contained in the reservoir, (d) regulating a quantity of inert gas in the bell to selectively apply pressure on the surface of the molten metal contained therein, (e) sensing the pressure of the gas within the bell, (f) sensing the level of the molten metal contained in the reservoir outside the bell, (g) maintaining a substantially constant pressure at the inlet of the nozzle by controlling the quantity of gas in the bell in response to the molten metal level, and (h) maintaining the level of the molten metal within the bell by controlling an input flow of molten metal to the reservoir in response to the gas pressure within the bell. Steps (g) and (h) may be accomplished with a microcomputer controller.

BRIEF DESCRIPTION OF THE DRAWINGS

Further details are given below with reference to the examples shown in the drawings in which.

DESCRIPTION OF THE PREFERRED EMBODIMENTS

Figure 1:
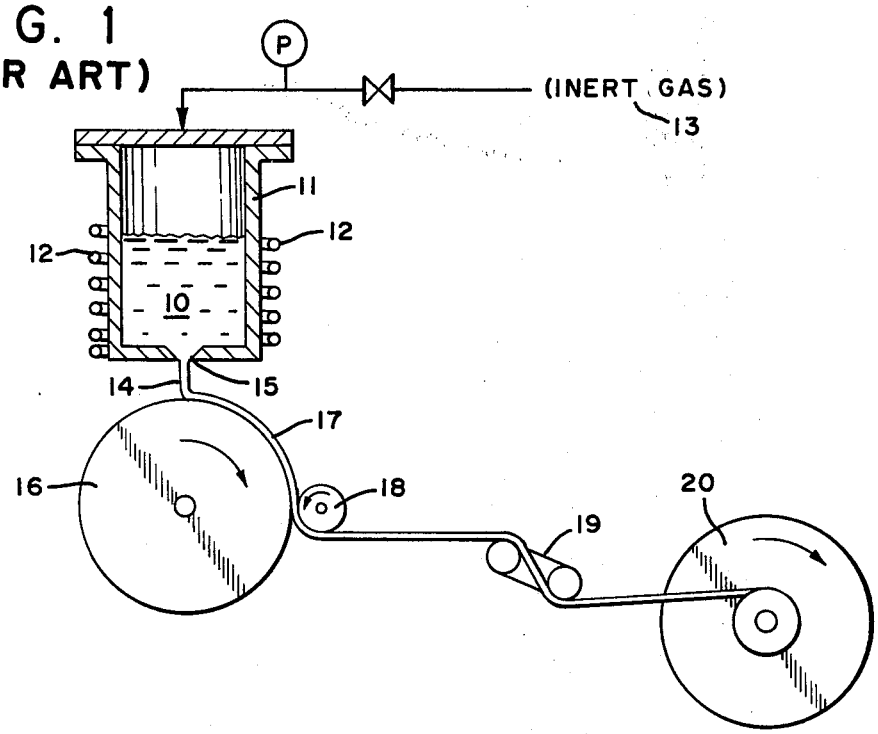
FIG. 1 (PRIOR ART)
FIG. 1 is an illustration of typical prior art apparatus for the continuous casting of glassy metal alloy continuous filament in which a molten stream is extruded from a pressurized crucible onto a rotating quench wheel, with the solidified filament being taken up by a winder.

Referring specifically to the drawings, in FIG. 1, typical prior art apparatus for the continuous casting of a glassy metal alloy continuous filament or strip is illustrated to point out the general use of the present invention. The molten alloy 10 is contained in an insulated crucible 11 provided with heating element 12. Pressurization of the crucible 11 with an inert gas 13 causes a molten stream 14 to be extruded through a nozzle or orifice 15 at the bottom of the crucible 11 onto a rotating quench wheel 16. The solidified filament 17 is taken around a nip roller 18, exerting a selected nip pressure, at its breakaway point on the quench wheel 16, then through a tension regulator 19, and finally onto a winding wheel 20.

The operation is conducted in the batch or semicontinuous mode since no provision is made for the continuous replenishment of the molten metal as it is extruded from the crucible. Restated, the operation does not continue indefinitely, since casting stops upon the charge being depleted. Further, the pressure at the extrusion nozzle inlet is not necessarily held constant as the molten metal level in the crucible drops during extrusion of a batch. Such extrusion pressure variation may cause the character of the stream to vary and therefore may cause unacceptable variation in the transverse dimensions of the strip along its length.

Figure 2:
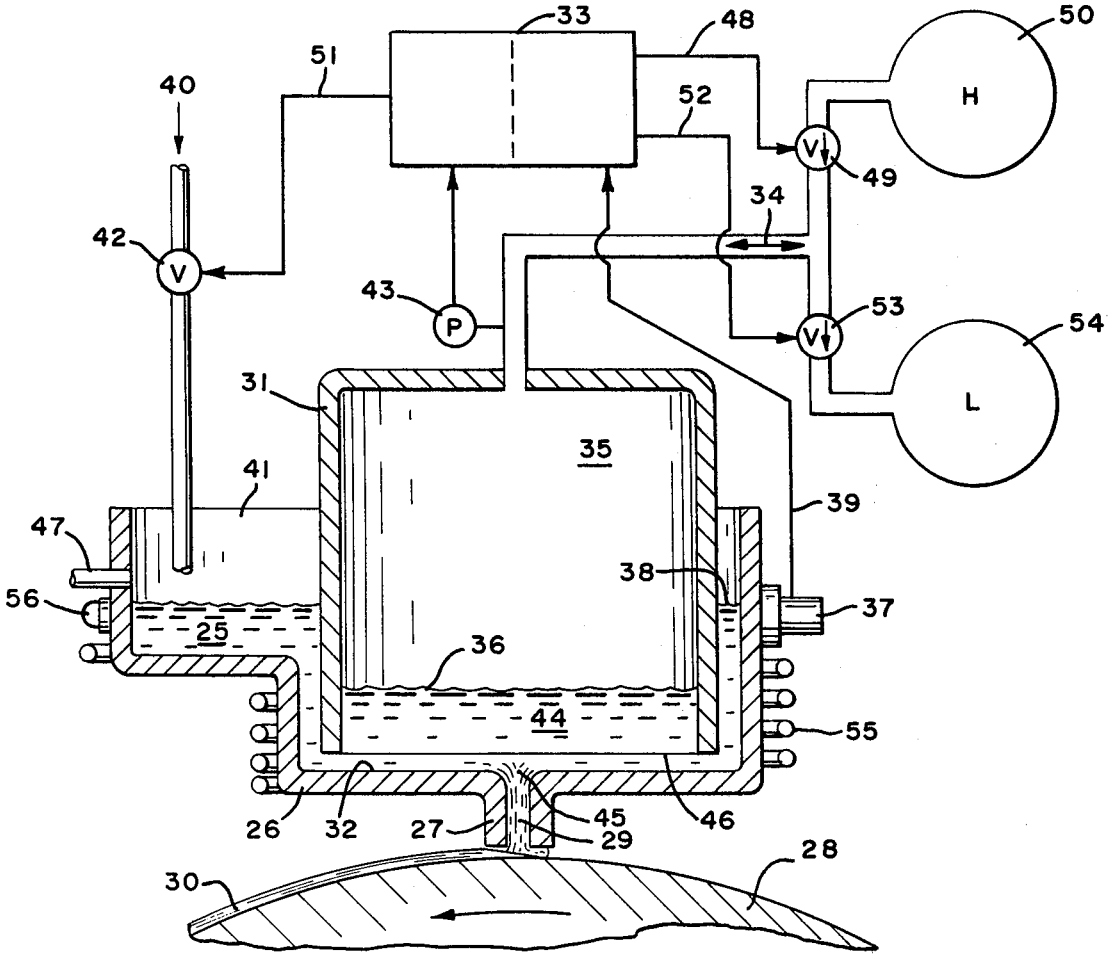
FIG. 2 is a cross-sectional view of the present invention showing a pressure bell disposed in a crucible containing molten metal with control elements for providing a continuous flow of molten metal at a constant pressure at the inlet of the extrusion nozzle, the nozzle directing a stream of molten metal onto a rotating quench wheel.

In FIG. 2, a cross-sectional view of the present invention is shown. Molten metal 25 is contained in a tundish-type crucible 26 having a heating element 55 for maintaining the melt temperature and an extrusion nozzle 27 in its base. Various nozzle configurations may be utilized with the present invention. Molten metal is extruded through the nozzle 27 onto a rotating quench wheel 28, shown generally, where the stream 29 is solidified at extreme quench rates, typically $10^{6}$° C. per second, to form a glassy metal alloy filament 30. A close-fitting inverted pressure bell 31 is disposed in the crucible 26 below the liquid level but spaced from the base 32 of the crucible. The bell material must be suitable for use in high temperature molten metal and may, for example, be fused silica. A controller 33, such as a microcomputer controller with appropriate input and output signal conditioners, provides a flow of inert gas 34 to the pressure bell volume 35 to regulate the gas pressure exerted on the liquid surface 36 within the bell. This function is accomplished by the controller 33 transmitting a command signal 48 to open servo-valve 49 from its nominally closed position for the release of inert gas 34 from a high pressure source 50. An example of a suitable microcomputer controller is one manufactured by Comptrol, Inc. of Cleveland, Ohio, and designated model IMC-85.

A level sensor 37 senses variation in the liquid level 38 outside the pressure bell to supply an input signal 39 to the controller 33, which in turn acts to maintain a substantially constant liquid level 38 outside the bell. The level detection system is generally of the noncontacting type. Specifically, the preferred level detection system is of the radiation transmission type. A radioactive material 56 is positioned outside the crucible so as to transmit a beam of gamma radiation through a portion of the molten alloy outside the bell. An appropriate radiation detector is positioned to receive the transmitted beam over the height range desired. Thus, the liquid level may be correlated to the intensity of the transmitted beam. Such level detectors are available from Kay-Ray, Inc. of Arlington Heights, Ill.

The crucible 26 is adapted to receive a replenishing flow of molten metal 40 in a pour tray 41. The flow of molten metal 40 to the tray 41 is regulated by controller 33 in response to the gas pressure within the bell, hereinafter referred to as bell pressure, as sensed by a pressure transducer 43. As the bell pressure is increased to lower the liquid level 36 inside the bell, the controller 33 acts to prevent the volume of liquid 44 inside the bell from being depleted. This function is accomplished by the controller 33 transmitting a command signal 51 to open servo-valve 42 from its nominally closed position for the inflow of molten metal 40. Concurrently, to replenish the molten metal supply in the bell, the controller 33 reduces the bell pressure by transmitting a command signal 52 to open servo-valve 53 from its nominally closed position to outflow gas from the bell to a low pressure sink 54. Servo-valves 49 and 53 are not simultaneously open. An overflow conduit 47 may be provided to prevent spillage in the event of malfunction.

In use, the system is situated over the rotating quench wheel 28. Initially, the bell pressure is maintained at subatmospheric so that the liquid level 36 inside the bell is higher than the liquid level 38 outside the bell, with the result that the high surface tension liquid metal is prevented from flowing through the nozzle inlet 45. To start the extrusion, the bell pressure is increased until nozzle flow begins and further increased to raise the liquid level 38 outside the bell to a preselected height corresponding to a preselected pressure head at the nozzle inlet 45. As extrusion begins, the liquid level 38 tends to drop as the molten metal in the crucible is diminished. The level sensor 37 detects the level change and transmits an input signal 39 to the controller 33, which in turn increases the bell pressure to force liquid 44 from the bell and thereby to restore the outside level 38 to the nominal height.

This compensating process continues with the bell pressure increasing and the inside liquid level 36 decreasing. As the inside liquid level 36 approaches the lower edge 46 of the pressure bell 31 and correspondingly as the bell pressure approaches a high limit, the controller 33 causes molten metal 40 to flow into the tray 41 of the crucible 26, and thereby causes the outside level 38 to rise. The outside level sensor 37 detects this positive change and supplies a corresponding signal 39 to the controller 33 which reduces the bell pressure by outflowing gas from the bell volume 35. The inside level 36 increases, decreasing the outside level 38 to its nominal height.

In operation, these functions are carried out concurrently and automatically, according to appropriate programming of the controller, so as to maintain the pressure head 38 at the nozzle inlet 45 within an acceptable operating range. As an example of a suitable programming scheme, the on-off control mode may be utilized over a short control interval, from about 1 second down to the microsecond range, wherein input variables are updated and compared to their respective standards and flow rates are correspondingly varied in a stepwise fashion. The time span of the control interval is selected to optimize the responsiveness and stability of the system. Another selectable response parameter is the diameter of the pressure bell 31 which is selected for a close fit with the crucible 26 to minimize the volume of liquid metal outside the bell and therefore to render the outside level 38 highly sensitive to a small decrease in the inside level 36 (small increase in bell pressure), tending to increase the responsiveness and stability of the system. Control requirements are stringent due to several factors: first, extrusion pressure is low, typically about 1.2 atmospheres absolute corresponding to an outside liquid level 38 of roughly 25 centimeters, thus a 10% control band, for example, implies a 2.5 centimeter outside level control band; second, the time scale for a control sequence is small for desirable high casting speeds, for example, about 4.5 kilograms per minute for a cast strip of 0.006 square centimeter cross-section at a casting speed of 900 meters per minute; and third, the crucible size is preferably of the same magnitude generally as the quench wheel, typically about 0.5 meter diameter, to minimize the weight of the loaded crucible as some casting configurations require an extremely small, precise separation between the nozzle outlet and the quench surface.

The system also provides nearly instantaneous on-off capability, thus facilitating emergency shutdown or intentional interruptions, as for example to replace a removable nozzle. By rapidly reducing the bell pressure to subatmospheric, nozzle flow is stopped. Operation is easily continued by increasing the bell pressure to the pre-shutdown pressure.

While preferred embodiments of the invention have been illustrated and described, it will be recognized that the invention may be otherwise variously embodied and practiced within the scope of the following claims:

What is claimed is:

1. Apparatus for the continuous casting of continuous filaments of glassy metal alloy comprising:

(a) a chill roll having cooling means for quenching a stream of molten metal at a quench rate sufficient for glass formation;

(b) a nozzle which has an orifice disposed so as to direct a stream of molten metal onto the chill surface of said chill roll; and (c) extrusion means for continuously and indefinitely extruding molten metal through said nozzle at a substantially constant pressure from a non-pressurized reservoir containing molten metal and communicating with said nozzle, said reservoir having a pressure bell disposed internally thereof for applying pressure to said molten metal and being constructed to minimize the volume of molten metal in said reservoir outside said bell, maximize the change in level of the molten metal outside said bell in response to a change in bell pressure, provide a substantially constant pressure at said orifice and provide a nearly instantaneous on-off capability to interrupt extrusion, said pressure bell being inverted, disposed in said reservoir, spaced from the bottom surface thereof and having its side walls partially immersed below the level of molten metal contained in said reservoir; and said extrusion means further comprising:

(1) a gas regulator for regulating a quantity of inert gas in said bell to selectively apply pressure on the surface of the molten metal contained therein;

(2) a pressure sensor for sensing the pressure of the gas within said bell;

(3) level detection means for sensing a preselected height of the molten metal contained in said reservoir outside said bell, which corresponds to a preselected pressure head;

(4) first control means for maintaining a substantially constant pressure at said nozzle orifice by controlling the quantity of gas in said bell in response to said level detection means to thereby provide said substantially constant pressure at said nozzle orifice; and (5) second control means for maintaining the level of the molten metal within said bell by controlling an input flow of molten metal to said reservoir in response to said pressure sensor.

2. Apparatus as in claim 1 wherein said level detection means comprises a radiation transmission level detection system, and said first and second control means comprise a microcomputer controller.

3. A method for the continuous casting of continuous filaments of glassy metal alloy, comprising:

(a) moving a chill surface of a chill roll, having cooling means for quenching a continuous flow of molten metal at a quench rate sufficient for glass formation, past a nozzle which has an orifice disposed so as to direct a stream of molten metal onto the chill surface of said chill roll; and (b) continuously and indefinitely extruding molten metal through said nozzle orifice at a substantially constant pressure from a non-pressurized reservoir, which contains molten metal and communicates with said nozzle, by application of pressure to a portion of said molten metal within a pressure bell disposed internally of said reservoir, the volume of molten metal within said bell being much greater than the volume of molten metal in said reservoir outside said bell, while maintaining a nearly instantaneous on-off capability to interrupt said extrusion, said pressure bell being inverted, spaced from the bottom surface of said reservoir, and having its side walls at least partially immersed below the level of the molten metal contained in said reservoir, and said extrusion step further comprising the steps of (1) regulating a quantity of inert as in said bell to selectively apply pressure on the surface of the molten metal contained therein;

(2) sensing the pressure of the gas within said bell;

(3) sensing a preselected height of molten metal contained in said reservoir outside said bell, which corresponds to a preselected pressure head;

(4) maintaining a substantially constant pressure at said nozzle orifice by controlling the quantity of gas in said bell in response to changes from said preselected molten metal height outside of said bell to thereby provide said substantially constant pressure at said nozzle orifice; and (5) maintaining the level of the molten metal within said bell by controlling an input flow of molten metal to said reservoir in response to the gas pressure within said bell.

4. A method as in claim 3 wherein step 3 is accomplished with a radiation transmission detection system, and steps 4 and 5 are accomplished with a microcomputer controller.

5. A method as in claim 4 wherein the linear casting rate is in the range of about 75 to 2100 meters per minute.

* * * * *